US006929719B1

(12) United States Patent
Giertz et al.

(10) Patent No.: US 6,929,719 B1
(45) Date of Patent: Aug. 16, 2005

(54) LEVELLER BAR FOR COKING OVENS

(75) Inventors: Hans-Josef Giertz, Ratingen (DE); Jürgen George, Bochum (DE); Klaus-Dieter Ruthemann, Gelsenkirchen (DE)

(73) Assignee: DMT Deutsche Montan Technologie GmbH, Essen (DE)

( * ) Notice: Subject to any disclaimer, the term of this patent is extended or adjusted under 35 U.S.C. 154(b) by 0 days.

(21) Appl. No.: 09/743,524

(22) PCT Filed: Jul. 2, 1999

(86) PCT No.: PCT/EP99/04578

§ 371 (c)(1),
(2), (4) Date: Jan. 5, 2001

(87) PCT Pub. No.: WO00/02976

PCT Pub. Date: Jan. 20, 2000

(30) Foreign Application Priority Data

Jul. 8, 1998 (DE) ..... 198 30 382

(51) Int. Cl.[7] ..... B01D 3/00; C10B 31/00

(52) U.S. Cl. ..... 202/239; 202/262; 202/270; 201/40; 414/198; 414/790.3; 414/792.1; 414/160; 414/511; 414/513; 414/514; 414/547

(58) Field of Search ..... 414/198, 790.3, 414/792.1, 160, 511, 513, 514, 547; 202/239, 262, 270; 201/40

(56) References Cited

U.S. PATENT DOCUMENTS 1,720,805 A * 7/1929 Ackeren et al. ..... 414/587
1,937,734 A * 12/1933 Underwood ..... 414/587
2,234,827 A * 3/1941 Koppers ..... 414/587
3,515,293 A * 6/1970 Cain ..... 414/587
3,616,947 A * 11/1971 Tucker ..... 414/587
4,181,578 A * 1/1980 Stauffer et al. ..... 202/239
4,264,263 A * 4/1981 Richmond, Jr. ..... 414/587
4,486,139 A * 12/1984 Hendrych ..... 414/215
4,491,505 A * 1/1985 Spindeler et al. ..... 202/270
4,555,209 A * 11/1985 Berenato et al. ..... 414/163
5,176,489 A * 1/1993 Schroter ..... 414/587
5,238,347 A * 8/1993 James ..... 414/165
5,925,222 A * 7/1999 Dudler ..... 202/262

* cited by examiner

*Primary Examiner*—Glenn Caldarola
*Assistant Examiner*—Alexis Wachtel
(74) *Attorney, Agent, or Firm*—Herbert Dubno

(57) ABSTRACT

The invention relates to a levelling bar for coking ovens, for levelling the cones of discharged coal which form under the filling holes of the oven chamber during the filling process. The levelling bar consists of two cheeks, such as plates (1), which extend essentially over the entire length of the ranged at a distance from each other depending on the width of the oven chamber, and parallel to each other. They are also interconnected and are essentially vertical. The levelling bar also has transversal coal carriers (2) which are arranged in the intermediate space delimited by the cheeks (1) at a mutual distance, one behind the other and which only extend over part of the cross-sectional surface of the levelling bar formed between he cheeks (1). The height (3) of the coal carriers (2), which take up the entire interval between the cheeks, is less than the height (H) of the cheeks (1) and the cheek form a gas channel (6) above the coal carriers (2) which is essentially free of built-in components.

16 Claims, 11 Drawing Sheets a b

LEVELLER BAR FOR COKING OVENS

CROSS REFERENCE TO RELATED APPLICATIONS

This application is a national stage of PCT/EP99/04578 filed 2 Jul. 1999 and is based upon a German national application 198 30 382.3 of 8 Jul. 1998 under the International Convention.

FIELD OF THE INVENTION

The invention relates to a levelling bar for coking ovens.

BACKGROUND OF THE INVENTION

EP 0 483 497 B1 describes a coke oven levelling bar which comprises two mutually parallel side members extending in the longitudinal direction of the oven and composed of sheet metal. In the space bounded by the side members at a uniform distance, transverse coal entrainers in the form of sheet metal walls of the height of the side members are arranged.

Shortly before the coal pile cone forming during the filling process and below the filling opening of the coke oven chamber reaches the gas collecting space which is to be maintained free, the levelling bar is inserted through the leveller door opening in the coke oven chamber and is moved back and forth to level out the coal pile cone. So that the free gas collection space above the coal is not blocked to a considerable extent, after the insertion of the levelling bar into the oven chamber during the filling process, the coal entrainers do not extend over the entire width of the intervening space between the two side members the coal entrainers are alternately offset to one another and are arranged on one or the other of the two side members. The side members are thus interconnected by spacer bars.

With this levelling bar it has been found that during the levelling, in spite of the alternating spaces of the levelling bar between the side members and the free ends of the coal entrainers, these alternating spaces can be blocked by the coal to be levelled so that the filling gas no longer can be sucked out unhindered to the collector. As a consequence, the emissions are more or less strongly uncontrolled since the filling gas is no longer freely sucked out via the riser pipe.

OBJECT OF THE INVENTION

The object of the invention is to provide a levelling bar with which at all times during the levelling operation a sufficiently free gas channel is guaranteed in the gas collecting space and simultaneously a good degree of oven filling is guaranteed.

SUMMARY OF THE INVENTION

This object is attained with a levelling bar for a coking oven for spreading the coal pile cone formed during the filling process under the filling openings of the oven chamber. The levelling bar is comprised of two substantially vertically arranged side members, like sheet metal plates, parallel to one another and spaced apart in dependence upon the width of the oven chamber and extending substantially the full length of the oven chamber. The bar is provided with coal entrainers extending transversely and arranged one behind the other at a mutual spacing in the intervening space bounded by the side members, which extend only over a part of the cross sectional area of the levelling bar formed between the side members. The heights of the coal entrainers over the entire distance between the side members is less than the height (H) of the side members. The side members above the coal entrainers form a gas passage which is substantially baffle free.

The height of the coal entrainers can correspond to at most half the height (H) of the side members. The number of coal entrainers is at least so great that the sum of all partial web surfaces corresponds to the sum of all full web surfaces of coal entrainers whose heights extend above the height (H) of the side members. The spacing of the coal entrainers can correspond to the height of the coal entrainers.

According to the invention the coal entrainers can have different heights. The coal entrainers can be affixed to the side members at an angle deviating from the vertical. The coal entrainers can be movably fastened on the side members. The cross sections of the coal entrainers can be wedge shaped or otherwise profiled or perforated. The support and guide rollers for the levelling bar can have a bevel.

The support and guide rollers can be laterally shiftable by a shifting device. The side members can have openings and in the openings ribs can be arranged or ribs can laterally bound the openings. The ribs can be arranged at an angle to the side members deviating from 0°.

The cheeks of the levelling bar can widen outwardly at their front end.

The levelling bar according to the invention affords the advantage that during the levelling process, a free gas channel is formed between the side members of the levelling bar in the intervening space and through which the filling gas can flow off unhindered horizontally to the riser pipe or to the collector.

This gas channel is especially dependably formed when, according to a further feature of the invention, the height of the coal entrainer is at most half the height of the side members.

Since the levelling bar is open at the front, it shifts into the coal pile cone and entrains the coal pile cone with the coal entrainers. There is no build up, like with known levelling bars, of a coal pile cone ahead of the levelling bar. So that the levelling bar will have a sufficient transport capacity, according to the invention, the number of coal entrainers is increased so that the transport capacity of the levelling bar according to the invention has at least the transport capacity of the known levelling bar (EP 0 483 497 B1), the number of coal entrainers is at least so great so that the sum of all partial transverse web areas corresponds to the sum of the full transverse web area of the coal entrainers whose heights extend over the height of the side members.

At a maximum the number of coal entrainer should be that which gives a spacing of the coal entrainer corresponding to the heights thereof. With this embodiment to insure that the coal in all cases will fall through the coal entrainer into and through the cells formed by the coal entrainer. No coal bridges can build up on the coal entrainers.

Because of the increased number of coal entrainers with the levelling bar according to the invention, the transport capacity is increased so that with each back and forth movement of the levelling bar more coal is transported.

In this manner, continued formation of the coal pile cone under the filling openings is precluded to the greatest possible extent. When the levelling bar is moved with a higher frequency than has hitherto been customary in the oven chamber, pile cone formation in the levelling bar height is avoided.

The coal entrainers arranged one behind the other can also have different heights. With this configuration, high pile ups of coal ahead of the coal entrainers can be precluded. The coal falls over a coal entrainer of reduced height into the cell lying rearwardly of that coal entrainer without the build up of a pile of the coal. Thus it is insured that above the coal which overflows the coal entrainer, a free gas channel is maintained within the levelling bar for carrying away the filling gas.

It is also possible to affix the coal entrainers at an angle deviating from the vertical to the side members of the levelling bar. Thus several coal entrainers can be arranged with their upper edges inclined toward the rear end of the levelling bar and other coal entrainers with their upper edges inclined toward the front end of the levelling bar. With the inclined arrangement toward the rear, the overflow of coal is facilitated during the forward movement of the levelling bar. If the coal entrainers are inclined forwardly, the coal in this region is somewhat pressed down and the levelling bar experiences a certain upward force. In addition, the inclined coal entrainers function as baffles during the filling process. The coal is passed through the coal entrainers from the filling holes into the regions between the filling holes. In this manner the coal pile cone formation is reduced.

It is also possible to arrange the coal entrainers so that they are movable. Thus, for example, a part of the coal entrainers can be movably mounted in their upper or lower regions on the side members of the levelling bar. With each forward or back displacement of the levelling bar they alter their positions and level the coal in the corresponding inclined position. So that the coal entrainers cannot be oriented horizontally, the inclined positions can be limited by an abutment.

A further possibility resides in that the coal entrainers are configured like wedges. In that case, it is possible for the wedge point to be oriented upwardly or downwardly. Such a wedge shape facilitates construction of the levelling bar since the wedge shaped coal entrainers enable reduction in the material thickness.

The cheeks of the levelling bar can also be configured with a wedge shape. In that case, the statics of the levelling bar are improved. When the wedge point is oriented downwardly toward the coal to be levelled, the coal cannot jam between the wedge shaped cheeks since the intervening space widens downwardly.

So that the force generated by the coal on the levelling bar will be reduced during the filling process, the upper edges of the cheeks and/or of the coal entrainers can be bevelled on one side or on both sides.

The levelling bar stroke, the levelling frequency, the number, spacing and heights of the coal entrainers must be mutually determined based upon the coal mass flow of the filling unit.

It is known that the levelling process below the filling holes of the oven chamber upon the coal pile cone results in pile cone stripes remaining between the chamber walls and the cheeks of the levelling bar. Apart from hindering the gas discharge, these coal pile stripes can give rise to graphite deposits in the coal collecting space in these regions. One possibility for avoiding these pile cone stripes is to impart a swinging movement or wobbling movement to the levelling bar during the levelling process. To achieve this, the support and guide rollers of the levelling bar can be configured with a bevel which generates the oscillating or wobbling movement of the levelling bar. Another possibility for avoiding the pile cone stripes is to form the mounting and guide rollers with a lateral shifting unit. Because of this shiftability, the levelling bar during the levelling process eliminates the pile cone stripes on the two sides of the gas collecting space. The elimination of the pile cone stripes can be improved by providing outwardly extending ribs on the cheeks or forming them from corrugated sheet.

According to a further feature of the invention, the cheeks have openings. A lateral coal infall is possible through these openings into the cells formed between the coal entrainers. The effectivity of the levelling process is thereby enhanced.

The openings can be made sufficiently large that they are interrupted only by ribs on which the coal entrainers are fastened. The ribs also can be inclined.

The levelling bar, in this embodiment, is formed as a rectangular cellular girder in cross section which blocks the gas collecting space only to a minor extend during the levelling process. Thus a plugging of the gas collecting space with coal is especially effectively limited and the filling gases which are produced during the filling process can be carried off in the longitudinal direction of the oven unhindered. Because the cellular construction of the levelling bar, a lateral throughflow of the levelling bar, i.e. transverse, to the oven longitudinal direction is also possible.

The individual ribs which are arranged at the openings of the cheeks can be oriented at an angle to the cheeks. In this manner, coal on the sides of the coke oven, chamber can be better stripped off.

The side members of the levelling bar can widen outwardly at their front ends.

In this configuration, the coal is stripped at the sides of the coke oven chamber at the levelling bar points directly.

According to a further feature of the invention, the levelling bar has at its front end one or more guide stirrups. The guide stirrups or guide stirrups serve to enable the levelling bar to be passed effectively through the leveler opening.

In this manner, the levelling bar can be inserted into the coal pile cone with its front end until the guide stirrup or guide stirrups open without the build up of a coal dam. The subsequent coal entrainer will then displace the coal pile cone and level the coal filling.

At the front end of the levelling bar or in the region of the cheek openings, movable coal scrapers can be arranged. Because of the effect of the forces of the coking coal on the coal scrapers during the backward movement of the levelling bar, the movable coal scrapers are pressed onto the walls of the coke oven chamber. In a new forward displacement of the levelling bar, the pile cone strips are carried away from the furnace walls by the opened coal scrapers. Upon removal of the levelling bar from the oven chamber, the laterally swung out coal scrapers are brought into a closed position by the frame of the leveller opening. Upon insertion into the next oven chamber, the coal scrapers can facilitate insertion as guide stirrups.

The levelling process can, according to the invention, be improved by the use of a gas under pressure.

For this purpose, fluid supply ducts are provided on the cheeks of the levelling bar with nozzles. The gas serves, in the first instance, to blow away the pile cone stripes which remain as the levelling bar passes through the coal pile cone. The nozzles can be at the same level distributed over the levelling bar length one after the other and/or can be arranged one above another.

It is especially advantageous when the nozzles are combined with a levelling bar which has openings in the side members. Then the blown away coal can pass through the openings into the intervening space between the side members and can be transported by the coal entrainers.

As has already been indicated, with the levelling bar of the invention a gas passage is guaranteed in the gas collecting space through which the filling gas can be sucked off. In the region of the leveller opening of the respective oven chamber, however, there is the danger that false air will be sucked through the gas passage. Thus the invention provides that the levelling bar can be sealed by a sealing and guide box. This sealing and guide box should have baffle partition walls extending from above until just above the coal entrainers and which are connected by a sealing plate and thus seal the gas passage. Under the levelling bar the sealing is completed by a sealing plate.

To further improve the sealing of the levelling bar, the levelling bar can be closed to form a housing which sealingly engages the leveller door opening.

In the embodiment of the levelling bar in which the coal entrainers are of different heights, the sealing and guide box can be equipped with hinges that allow the relevant partitions of the sealing and guide box to swing back and forth and thus compensate for the height difference of the coal entrainers. In addition, the movable partitions can be offset from the underpressure side so that the underpressure effect can be limited. To increase the sealing effect, several sealing and guide boxes can also be arranged one behind the other. Each sealing and guide box should be larger than the distance between the coal entrainers so that at least two coal entrainers are covered by the sealing and guide box.

To further enhance the gas channel formation, the coal entrainers can be provided with openings. The number of openings is optional so that, in an extreme case the coal entrainer is configured as a perforated sheet metal plate. Advantageously, openings are arranged in an upper portion of the coal entrainer or the openings in the upper portion are made larger. The gas passage between the side members are thus partially enlarged in the region of the coal entrainer. It is also possible to make the coal entrainer exactly as high as the side members and to form a gas passage by openings in the coal entrainers.

The aforementioned examples and the claimed features provided an inventive construction whose components with respect to dimensions, shapes, choice of materials and technical conceptions have no special limitations so that they can be used in the respective field with any known criteria in an unlimited manner.

BRIEF DESCRIPTION OF THE DRAWING

Further details, features and advantages of the subject matter of the invention are given in the following description of the associated drawing in which, by way of example, preferred embodiments of the levelling bar with gas passage are illustrated. In the drawing.

SPECIFIC DESCRIPTION

Figure 1:
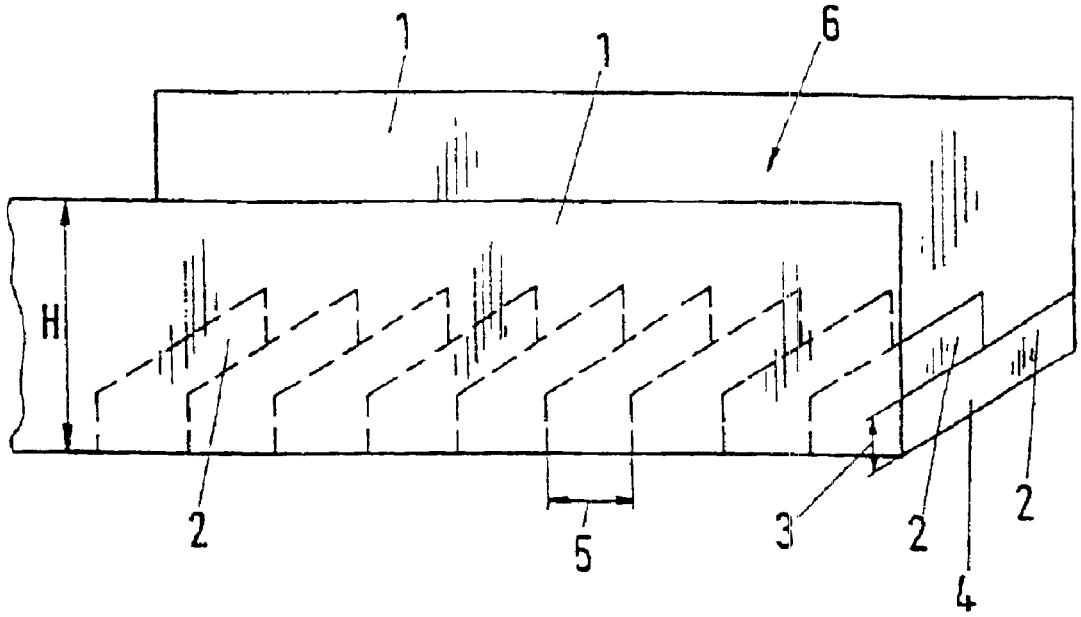
FIG. 1 is a perspective view of a first embodiment of the levelling bar according to the invention.

FIG. 1 shows a levelling bar of the side members 1 and coal entrainer 2 arranged between the cheeks 1. The heights 3 of the coal entrainers 2 are significantly less than the height H of the side members 1. The coal entrainers 2 are arranged one behind the other at a spacing 5. Its cross bar area 4 covers only a minor part of the space between the side members 1 so that they form a free gas passage 6.

Figure 2:
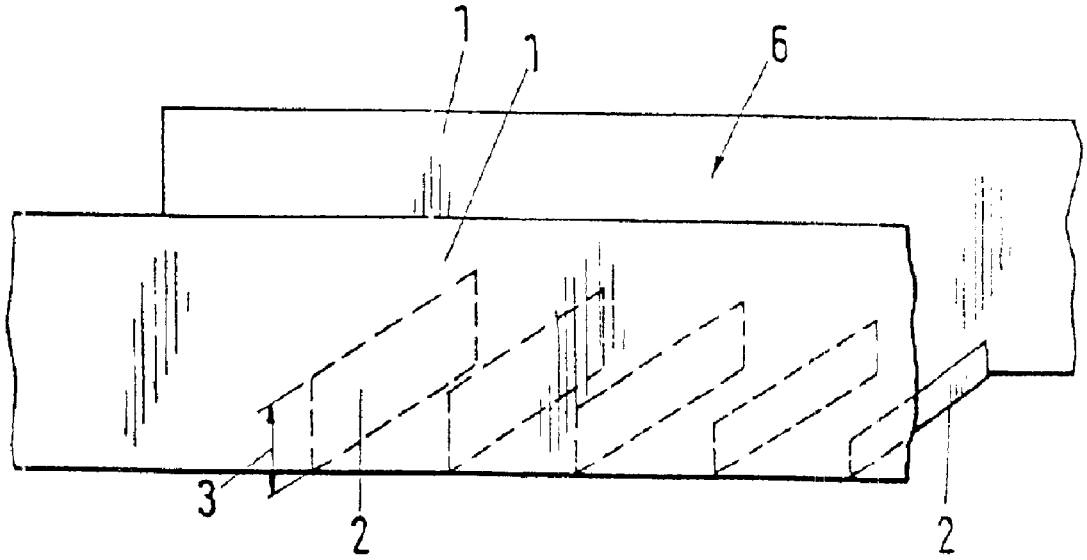
FIG. 2 is a perspective view of a second embodiment of the levelling bar.

From FIG. 2 it is apparent that between the side members 1 coal entrainers 2 are arranged one behind the other and have different heights 3. In this embodiment it is advantageous that the first, lowest coal entrainer 2 does not cause a pile up of any coal hill ahead of it. The overflowing coal can fill into the next stage and is there further transported. Above the coal entrainer 2, at every point in time, a free gas passage 6 is provided.

Figure 3:
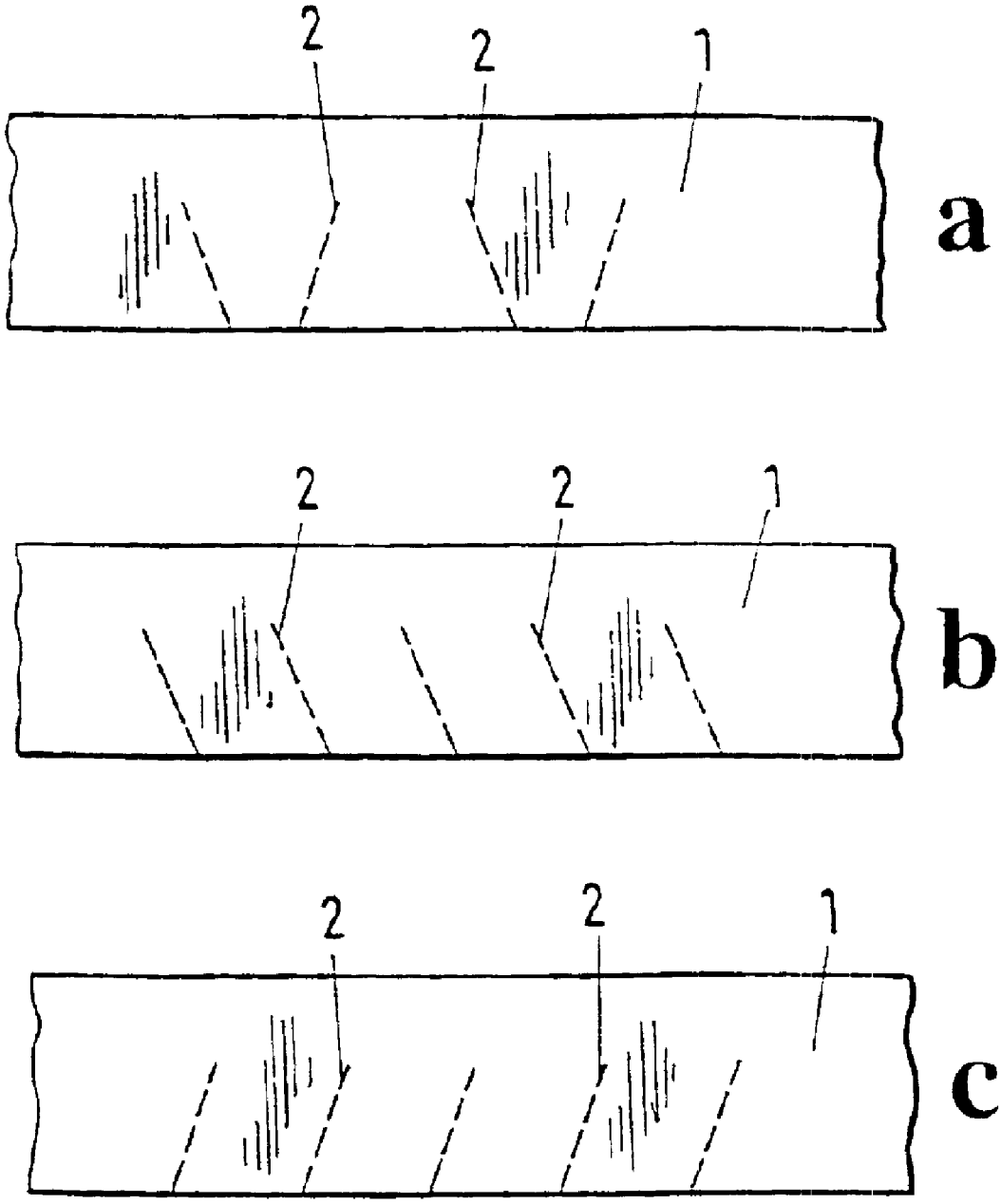
FIG. 3 is a side elevational view of parts of a third levelling bar with coal entrainers set at a bias.

FIG. 3 shows, for example, coal entrainers 2 which are affixed at angles deviating from the vertical on the side members 1. With the coal entrainers 2 during the filling process, the coking coal falling into the oven chamber is distributed in the oven and thus the pile cone formation is counteracted.

Figure 4:
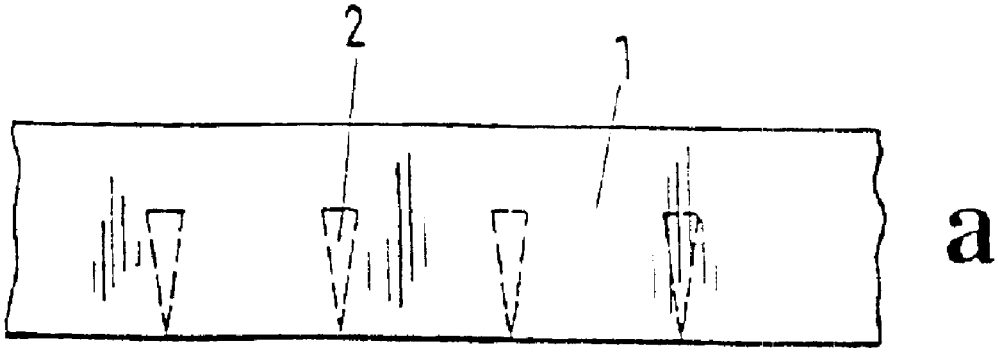
FIG. 4 is a fourth embodiment of the levelling bar.
Figure 4:
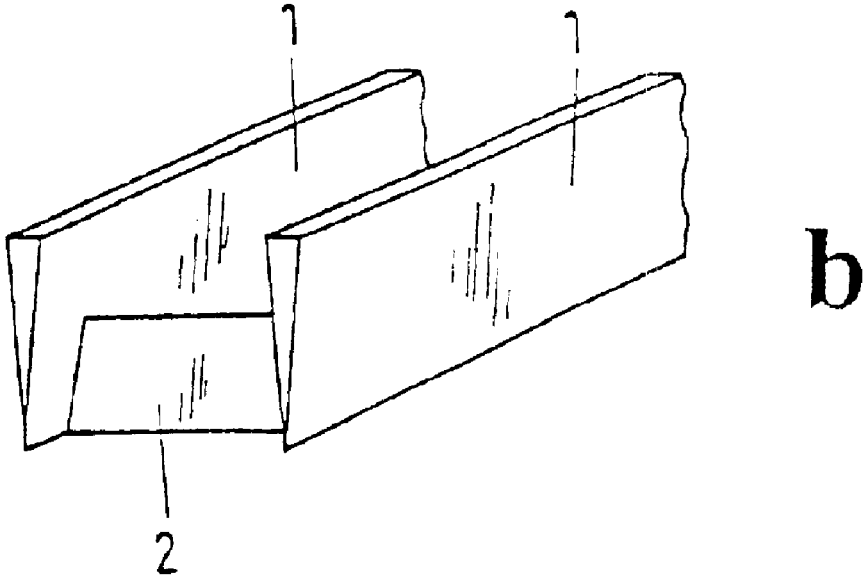

FIG. 4 shows, a wedge-shaped embodiment of the coal entrainers 2 and the side members 1. With this arrangement a plugging of the transport cells formed between the coal entrainers by the coking coal is reduced since the through-flow area for the falling coal widens downwardly.

Figure 5:
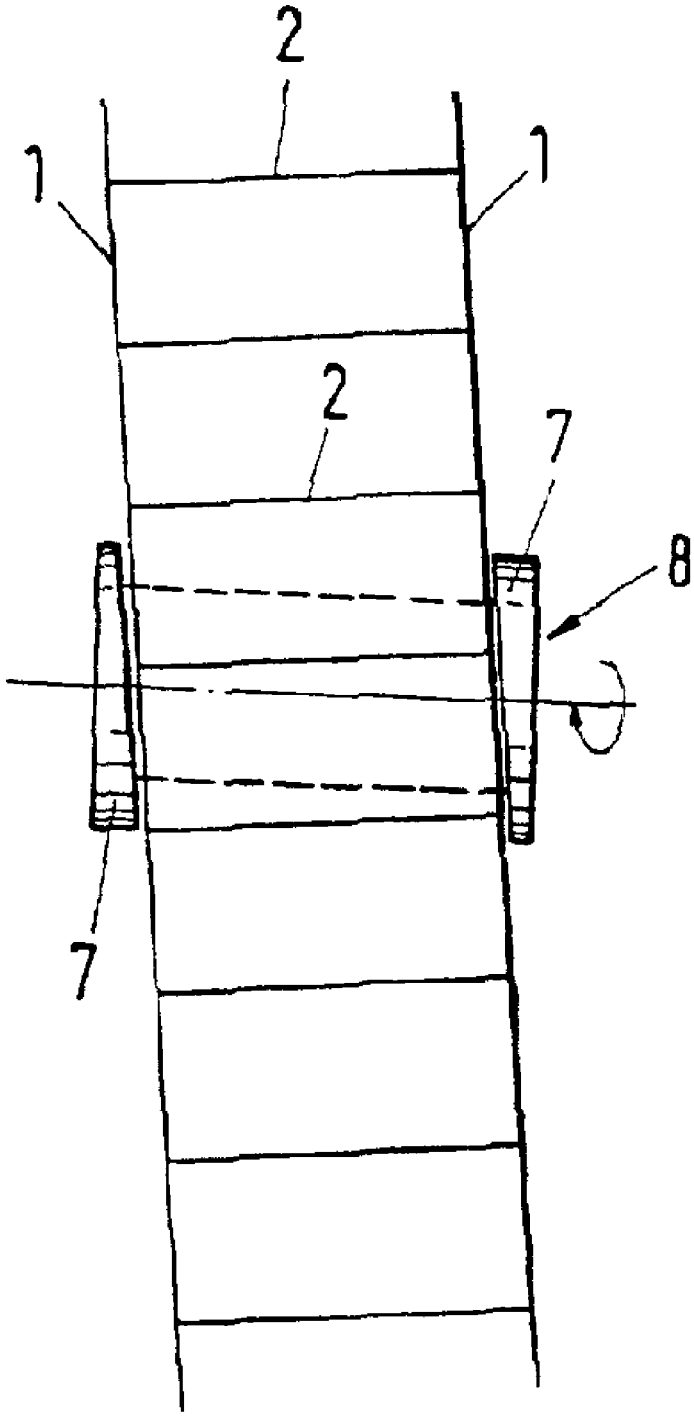
FIG. 5 is a plan view of the mounting and guide rollers of a levelling bar.

FIG. 5 shows the mounting of the levelling bar with the cheeks 1 and the coal entrainer 2. The mounting and guide rollers 8 have a bevel 7. The edges of the bearing and guide rollers 8 which guide the levelling bar, because of the bevel 7, at each rotation has a change in tracking as the levelling bar is moved back and forth. As a consequence, the levelling bar is laterally shifted during the levelling operation to eliminate possible pile cone strip formation beneath the filling holes and between the side members 1 and the oven walls.

Figure 6:
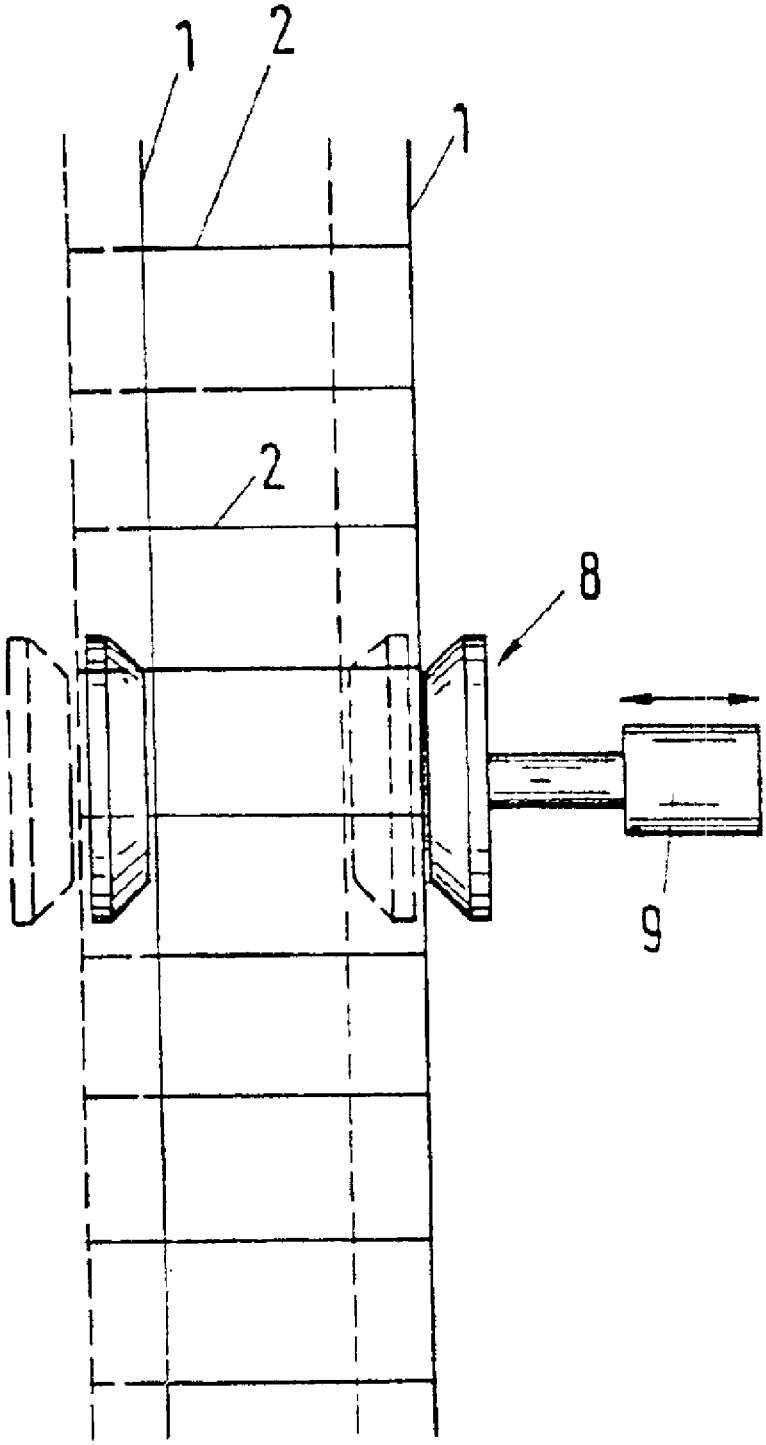
FIG. 6 is a shifting device for the mounting and guide rollers of a levelling bar.

FIG. 6 shows bearing and guide rollers 8 which are laterally shiftable by a shifting device 9. As a consequence, it is also possible to impart a lateral movement to the levelling bar and spread out any pile cone strips which might be formed.

Figure 7:
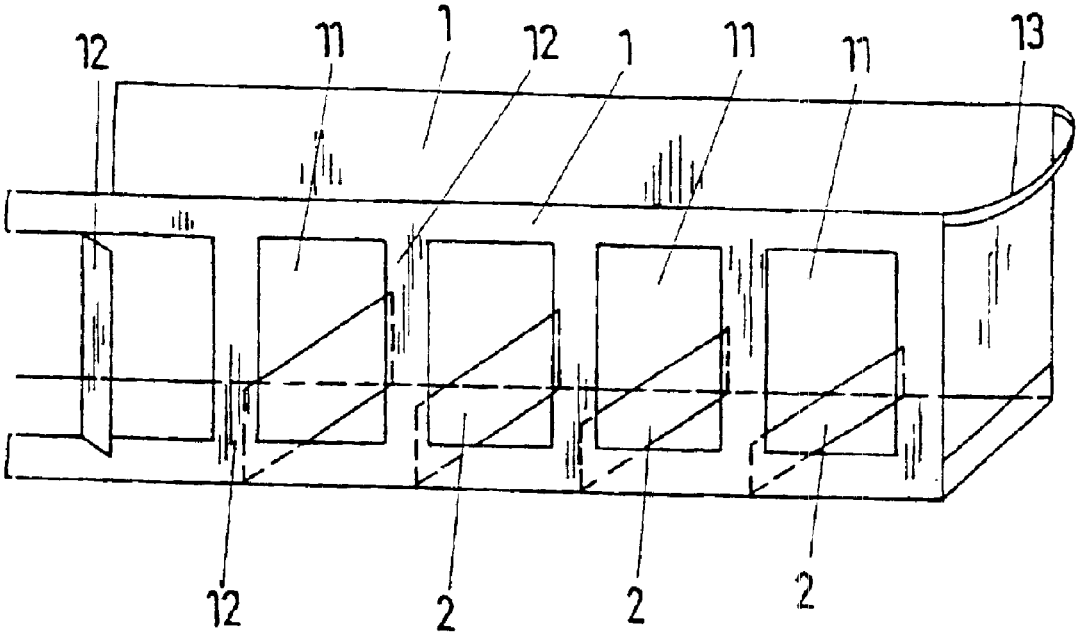
FIG. 7 is a fifth embodiment of a levelling bar in a perspective illustration.

In FIG. 7, a levelling bar has been illustrated whose cheeks 1 have openings 11 through the openings 11, coal can fall into the transport cells of the levelling bar between the coal entrainers 2 and during the levelling stroke can be distributed. The openings 11 are bounded by ribs 12 on which the coal entrainer 2 are affixed. The ribs 12 can be arranged at an angle to the side members 1. As a result, the coal can be guided more effectively into the transport cells between the coal entrainer. On the side members 1, a guide stirrup 13 can be arranged which eases the introduction of the levelling bar into the leveller opening.

Figure 8:
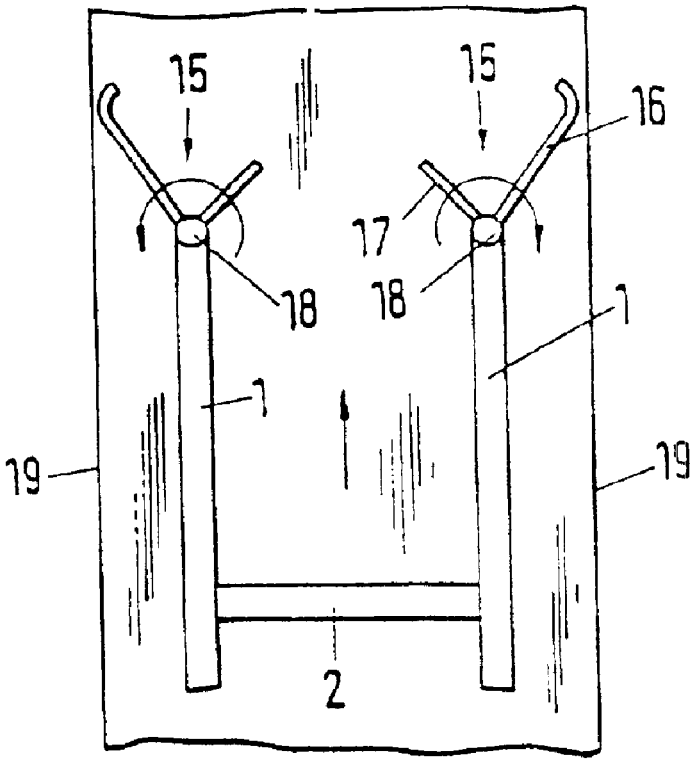
FIG. 8 is a plan view of a movable coal scraper of a levelling bar.
Figure 8:
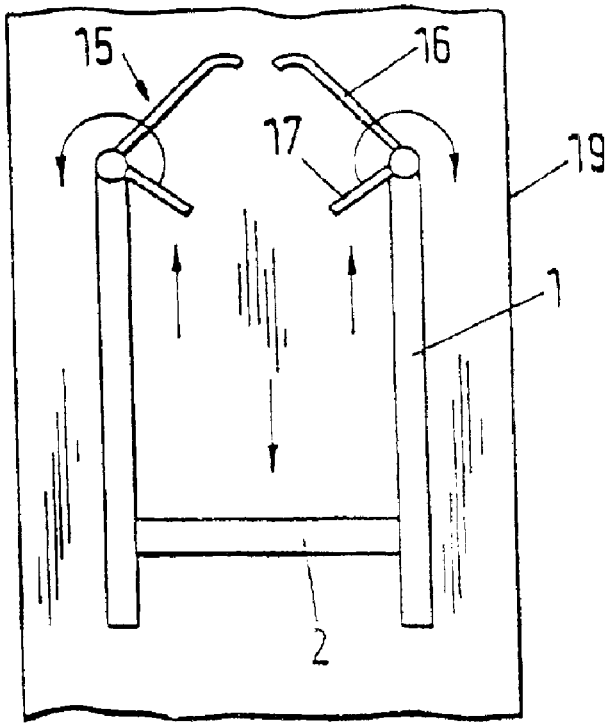

FIG. 8 shows that the front end of the levelling bar on the side members 1, movable coal scrapers 15 with the shanks 16 and 17 can be provided. The coal scrapers 15 rotate in a pivot 18. By the force generated by the coking coal during the rearwood movement of the levelling bar, the coal scrapers 15 is pressed via the shanks 16 and 17 against the wall of the coke oven chamber. Upon withdrawal of the levelling bar out of the oven, the coal scrapers 15 are brought through the frame of the leveller opening into the closed position shown in the lower part of FIG. 8.

Upon insertion into the next furnace chamber, the coal scraper 15 assumes the function of a guide stirrup.

Figure 9:
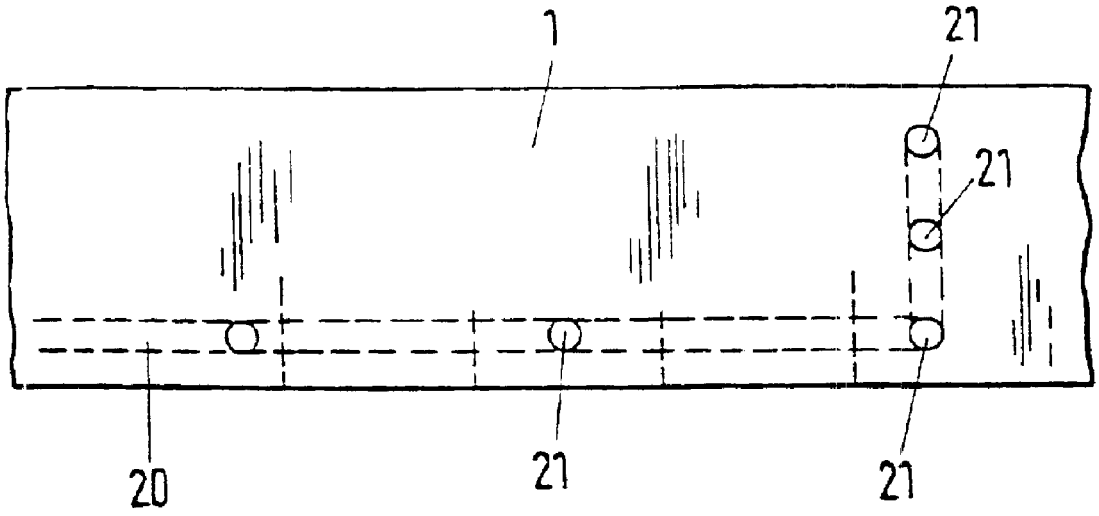
FIG. 9 is a side elevational view of a levelling bar with conduits and nozzles.

FIG. 9 shows that on the side members 1 conduits 20 with nozzles 21 can be arranged. Through the nozzles 21, a gas under pressure, e.g. nitrogen can be blown in during levelling so that the lateral piled cone strips can be eliminated or can never form. The nozzles 21 can be arranged optionally. Upon blockage of the nozzles additional swinging or wobbling movements are generated.

Figure 10:
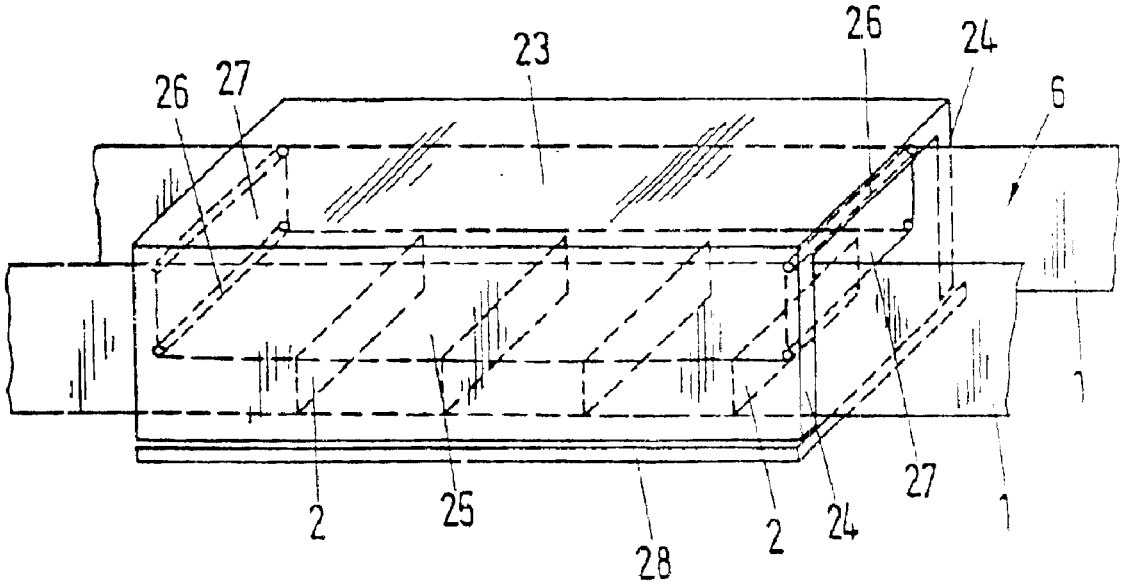
FIG. 10 is the arrangement of a sealing and guide box for a levelling bar.

From FIG. 10 it will be apparent that the gas passage 6 is sealed by a sealing and guide box 23. The gas passage 6 is largely sealed by a suspended sealing plate 25 of the sealing box 23 which is movable with the bearing or mounting shaft 26 and the bulk heated walls 27. Below the side members 1 and the coal entrainer 2, a sealing plate 28 is provided. This plate 28 can be part of the housing 24 which increases the levelling bar and engages sealingly against the levelling door opening which has not been shown. By this sealing, undesirable air entry into the oven during the gas evacuation is avoided.

Figure 11:
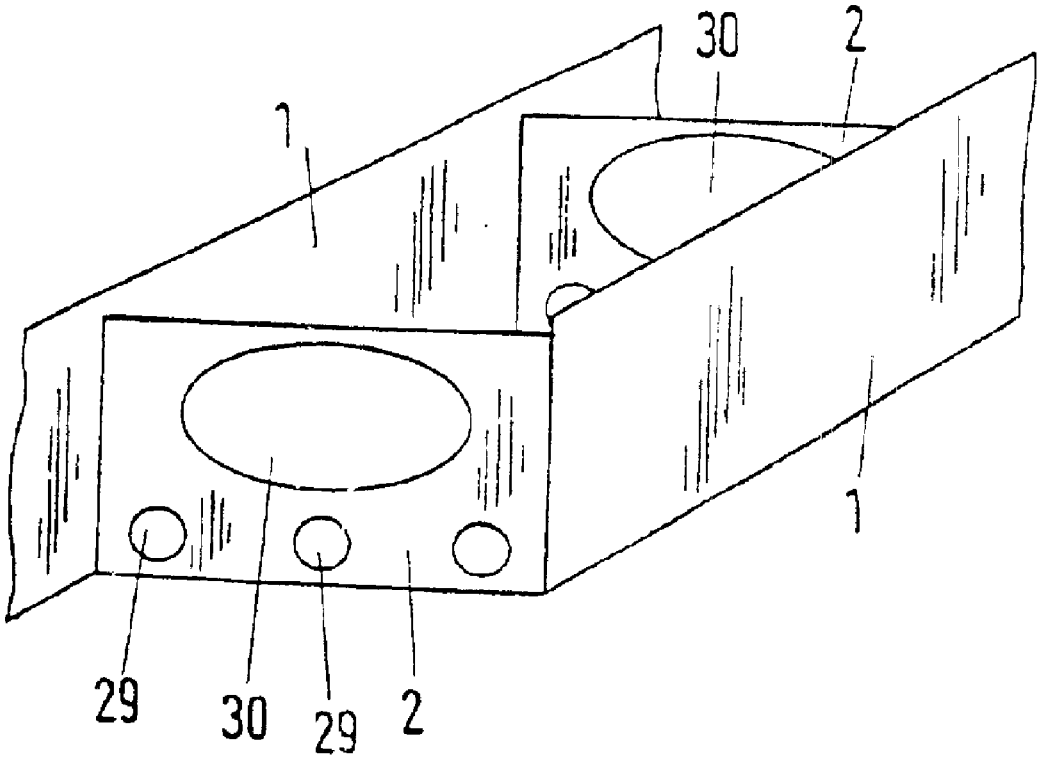
FIG. 11 is a sixth embodiment of a levelling bars with openings in the coal entrainers.

FIG. 11 shows coal entrainer 2 which have openings 29 and 30. Through the openings 29 and 30, the filling gas can emerge during the levelling process.

We claim:

1. A leveling bar for a coking oven, comprising:

a pair of mutually parallel spaced apart substantially vertical side members extending over a length of a coke oven chamber;

a multiplicity of coal entrainers spaced apart over the lengths of said side members, extending transversely between said side members, connected to said side members and occupying only a part of a cross sectional area of the leveling bar, said coal entrainers having heights of the entire spacing between said side members which are at most half the height of said side members; and a baffle-free gas passage formed in said leveling bar between said side members and above said coal entrainers over substantially the length of said leveling bar.

2. The leveling bar defined in claim 1 wherein the number of said coal entrainers is selected so that a sum of surfaces of said coal entrainers exposed between said side members is at least equal to the sum of the exposed surfaces of coal entrainers of conventional leveling bars without the passage.

3. The leveling bar defined in claim 1 wherein the coal entrainers are spaced apart by a distance corresponding to the height of the coal entrainers.

4. The leveling bar defined in claim 1 wherein the coal entrainers have different heights.

5. The leveling bar defined in claim 1 wherein the coal entrainers are oriented at angles to the vertical.

6. The leveling bar defined in claim 1 wherein the side members have wedge-shaped cross sections.

7. The leveling bar defined in claim 1 wherein said side members are perforated.

8. The leveling bar defined in claim 1, further comprising support and guide rollers engaging said leveling bar, said rollers having a bevel.

9. The leveling bar defined in claim 8, further comprising a shifting device for laterally shifting said support and guide rollers.

10. The leveling bar defined in claim 1 wherein said side members have openings laterally bounded by ribs oriented at angles to the side members.

11. The leveling bar defined in claim 1 wherein said entrainers have openings.

12. The leveling bar defined in claim 1 wherein the leveling bar is sealed with a sealing and guide box.

13. The leveling bar defined in claim 12 wherein the sealing and guide box has support shafts for the leveling bar.

14. A leveling bar for a coking oven, comprising:

a pair of mutually parallel spaced apart substantially vertical side members extending over a length of a coke oven chamber;

a multiplicity of coal entrainers spaced apart over the lengths of said side members, extending transversely between said side members, connected to said side members and occupying only a part of a cross sectional area of the leveling bar, said coal entrainers having heights of the entire spacing between said side members which are at most half the height of said side members;

a baffle-free gas passage formed in said leveling bar between said side members and above said coal entrainers over substantially the length of said leveling bar; and said coal entrainers being movably fastened on said side members.

15. A leveling bar for a coking oven, comprising:

a pair of mutually parallel spaced apart substantially vertical side members extending over a length of a coke oven chamber;

a multiplicity of coal entrainers spaced apart over the lengths of said side members, extending transversely between said side members, connected to said side members and occupying only a part of a cross sectional area of the leveling bar, said coal entrainers having heights of the entire spacing between said side members which are at most half the height of said side members;

a baffle-free gas passage formed in said leveling bar between said side members and above said coal entrainers over substantially the length of said leveling bar; and movable coal scrapers on said side members.

16. A leveling bar for a coking oven, comprising:

a pair of mutually parallel spaced apart substantially vertical side members extending over a length of a coke oven chamber;

a multiplicity of coal entrainers spaced apart over the lengths of said side members, extending transversely between said side members, connected to said side members and occupying only a part of a cross sectional area of the leveling bar, said coal entrainers having heights of the entire spacing between said side members which are at most half the height of said side members;

a baffle-free gas passage formed in said leveling bar between said side members and above said coal entrainers over substantially the length of said leveling bar; and fluid conduits with nozzles arranged on said side members.

* * * * *